US008920881B2

(12) United States Patent
Eichmann et al.

(10) Patent No.: US 8,920,881 B2
(45) Date of Patent: Dec. 30, 2014

(54) METHOD FOR PRODUCING A COMPONENT COVERED WITH A WEAR-RESISTANT COATING

(75) Inventors: Wolfgang Eichmann, Pucheim (DE); Karl-Heinz Manier, Scheyern (DE); Markus Uecker, Munich (DE); Thomas Uihlein, Dachau (DE)

(73) Assignee: MTU Aero Engines AG, Munich (DE)

( * ) Notice: Subject to any disclaimer, the term of this patent is extended or adjusted under 35 U.S.C. 154(b) by 409 days.

(21) Appl. No.: 11/665,415

(22) PCT Filed: Oct. 7, 2005

(86) PCT No.: PCT/DE2005/001795

§ 371 (c)(1),
(2), (4) Date: Apr. 13, 2007

(87) PCT Pub. No.: WO2006/042506

PCT Pub. Date: Apr. 27, 2006

(65) Prior Publication Data

US 2008/0124469 A1 May 29, 2008

(30) Foreign Application Priority Data

Oct. 16, 2004 (DE) ..... 10 2004 050 474

(51) Int. Cl.
*B05D 1/36* (2006.01)
*C23C 4/08* (2006.01)
*C23C 26/00* (2006.01)

(52) U.S. Cl.
CPC .. *C23C 26/00* (2013.01); *C23C 4/08* (2013.01)
USPC ..... 427/404; 427/270; 427/402

(58) Field of Classification Search
USPC ..... 427/402, 404, 270
See application file for complete search history.

(56) References Cited

U.S. PATENT DOCUMENTS 4,414,249 A * 11/1983 Ulion et al. ..... 427/248.1
4,428,213 A * 1/1984 Neal et al. ..... 72/53
4,481,237 A 11/1984 Bosshart et al.

(Continued)

FOREIGN PATENT DOCUMENTS

DE 42 29 600 11/1993
DE 93 21 489 8/1998

(Continued)

OTHER PUBLICATIONS

European Examiner Daniel Elsen, European Office Action in European Application No. 05 799 632.4—1215, dated Sep. 28, 2009, 4 pages, European Patent Office, Rijswijk, Netherlands, with partial English translation.

(Continued)

*Primary Examiner* — Robert S Walters, Jr.
(74) *Attorney, Agent, or Firm* — W. F. Fasse

(57) ABSTRACT

For producing a component, especially a gas turbine component, coated with a wear-protection, corrosion-protection or erosion-protection coating, a method includes the following steps: providing a component (10) to be coated on a component surface (13); at least partially coating the component (11) on its component surface with an at least two-layered protective coating (14), which includes at least one relatively soft layer (15) and at least one relatively hard layer (16); and then surface densifying the at least partially coated component on its coated component surface by ball blasting or shot peening.

12 Claims, 3 Drawing Sheets

(56) References Cited

U.S. PATENT DOCUMENTS

| | | | | |
|---|---|---|---|---|
| 4,528,079 | A | 7/1985 | Badger | |
| 4,562,090 | A | 12/1985 | Dickson et al. | |
| 4,761,346 | A | 8/1988 | Naik | |
| 5,059,095 | A | 10/1991 | Kushner et al. | |
| 5,169,674 | A * | 12/1992 | Miller | 427/456 |
| RE34,173 | E * | 2/1993 | Kerber | 428/610 |
| 5,232,789 | A | 8/1993 | Platz et al. | |
| 5,437,933 | A | 8/1995 | Coupland et al. | |
| 5,516,586 | A | 5/1996 | Singer et al. | |
| 5,547,767 | A | 8/1996 | Paidassi et al. | |
| 5,573,604 | A | 11/1996 | Gerdes | |
| 5,993,980 | A | 11/1999 | Schmitz et al. | |
| 6,214,475 | B1 | 4/2001 | Bamberg et al. | |
| 6,490,899 | B2 | 12/2002 | Berthelet et al. | |
| 6,780,458 | B2 * | 8/2004 | Seth et al. | 427/201 |
| 6,800,376 | B1 * | 10/2004 | Gupta et al. | 428/612 |
| 7,160,635 | B2 | 1/2007 | Leyens et al. | |
| 7,186,092 | B2 | 3/2007 | Bruce et al. | |
| 2002/0076573 | A1 * | 6/2002 | Neal et al. | 428/621 |
| 2002/0102400 | A1 | 8/2002 | Gorokhovsky et al. | |
| 2004/0022949 | A1 * | 2/2004 | Hasezaki et al. | 427/376.2 |
| 2004/0072038 | A1 | 4/2004 | Henderer | |
| 2004/0115471 | A1 | 6/2004 | Nagaraj et al. | |
| 2006/0040129 | A1 | 2/2006 | Darolia et al. | |
| 2007/0190351 | A1 | 8/2007 | Eichmann et al. | |

FOREIGN PATENT DOCUMENTS

| | | | | |
|---|---|---|---|---|
| EP | 0 186 266 | | 7/1986 | |
| EP | 0 188 057 | | 7/1986 | |
| EP | 0 366 298 | | 5/1990 | |
| EP | 0 386 618 | | 9/1990 | |
| EP | 0 471 505 | | 2/1992 | |
| EP | 0 492 323 | | 7/1992 | |
| EP | 0 679 733 | | 11/1995 | |
| EP | 0 697 503 | | 2/1996 | |
| EP | 0 713 972 | | 5/1996 | |
| EP | 0 919 699 | | 6/1999 | |
| EP | 1 208 942 | | 5/2002 | |
| EP | 1 338 670 | | 8/2003 | |
| EP | 1 382 709 | | 1/2004 | |
| GB | 826 057 | | 12/1959 | |
| GB | 2 397 307 | | 7/2004 | |
| JP | 11-343565 | | 12/1999 | |
| WO | WO 93/08315 | | 4/1993 | |
| WO | WO 9308315 | A1 * | 4/1993 | C23C 4/06 |
| WO | WO 96/12049 | | 4/1996 | |
| WO | WO 01/32799 | | 5/2001 | |

OTHER PUBLICATIONS

Wolfgang Eichmann et al., U.S. Appl. No. 11/472,626, filed Jun. 21, 2006, 17 pages.

German Examiner Gerlinde Schober, Office Action in German Patent Application No. 10 2004 050 474.1, mailed Feb. 6, 2013, 8 pages; with partial English translation.

* cited by examiner

METHOD FOR PRODUCING A COMPONENT COVERED WITH A WEAR-RESISTANT COATING

FIELD OF THE INVENTION

The invention relates to a method for the production of a component, especially a gas turbine component, coated with a wear-protection coating, especially a corrosion-protection coating or erosion-protection coating.

BACKGROUND INFORMATION

During their operation, gas turbine components are subjected to a high wear, especially through oxidation, corrosion or also erosion. It is therefore known from the prior art, to provide gas turbine components with corresponding wear-protection coatings. However, through the application of a wear-protection coating, the so-called HCF service life duration of the base material of the coated gas turbine component is reduced. In order to compensate this reduction of the HCF service life duration caused by the coating, it is already known from the prior art to subject the gas turbine component, which is to be coated, to a surface consolidation or densification, especially through ball blasting or shot peening, before the coating. Through the subsequent coating of the gas turbine component, which typically proceeds at elevated coating temperatures, however, a portion of the densification or consolidation achieved by the shot peening is again diminished or dissipated. Thus, the surface densification of the component to be coated, before the coating thereof with the wear-protection coating, is only conditionally effective.

It is already know from the JP 11-343565-A, to apply a coating of an intermetallic material onto a component of a titanium based alloy. The coating of the intermetallic material, according to this prior art, is subjected to a diffusion heat treatment and, if applicable, a surface densification by ball blasting or shot peening. In that regard, however, the problem arises that the brittle intermetallic diffusion coating is damaged during the surface densification.

SUMMARY OF THE INVENTION

Beginning from this, the problem underlying the present invention is to provide a novel method for the production of a component coated with a wear-protection coating.

This problem is solved by a method for the production of a component coated with a wear-protection coating according to the present invention, including at least the following steps: a) providing a component that is to be coated on a component surface; b) at least partially coating the component on its component surface with an at least two-layered or at least two-plied wear-protection coating, whereby the wear-protection coating encompasses at least one relatively soft layer and at least one relatively hard layer; c) surface densifying the at least partially coated component on its coated component surface.

In the sense of the present invention, it is proposed to apply an at least two-layered or at least two-plied wear-protection coating onto the surface of the component that is to be coated, and to subsequently subject the thusly coated component to a surface densifying through preferably ball blasting or shot peening. The at least two-layered wear-protection coating has at least one relatively soft layer and at least one relatively hard layer. Through the inventive combination of the coating of the component with a multilayer wear-protection coating with subsequent surface densifying, the energy applied to the wear-protection coating during the surface densifying can be reduced or dissipated without the existence of the danger of damages of the wear-protection coating.

BRIEF DESCRIPTION OF THE DRAWINGS

Preferred further developments of the invention arise from the dependent claims and the following description. Example embodiments of the invention are explained more closely in connection with the drawing, without being limited hereto. Thereby:

DETAILED DESCRIPTION OF EXAMPLE EMBODIMENTS OF THE INVENTION

In the following, the present invention will be described in greater detail with reference to the FIGS. 1 to 4.

Figure 1:
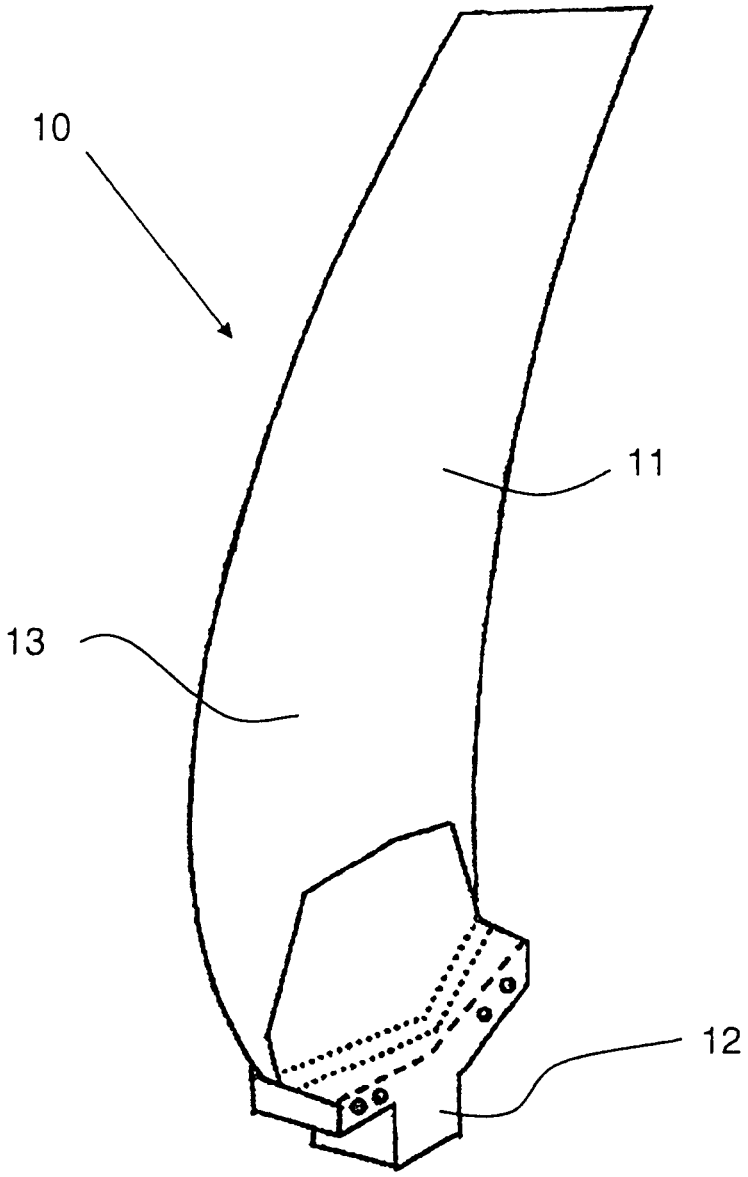
FIG. 1 shows a gas turbine vane that is to be coated, in a schematic side view.

In an exemplary fashion, FIG. 1 shows a gas turbine vane 10, which comprises a vane blade 11 as well as a vane root or pedestal 12, as a component to be coated with the inventive method. The provided or prepared gas turbine vane 10 shall now be coated, with the inventive method, in the area of the surface 13 of the vane blade 11 with a wear-protection coating, preferably with a corrosion-protection coating or erosion-protection coating.

Figure 2:
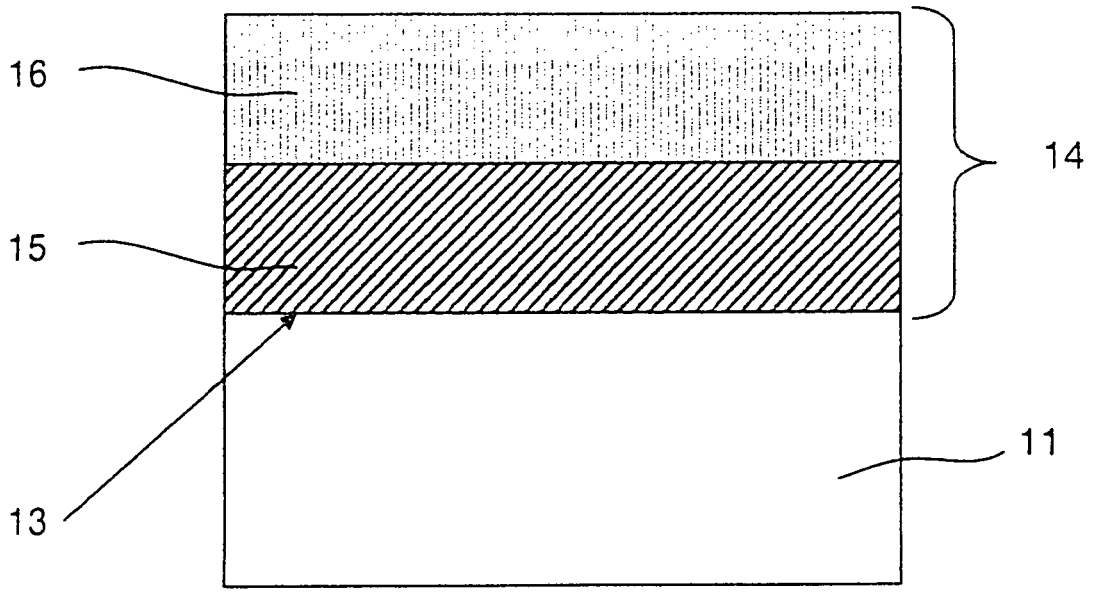
FIG. 2 shows a schematic cross-section through a wear-protection coating.
Figure 3:
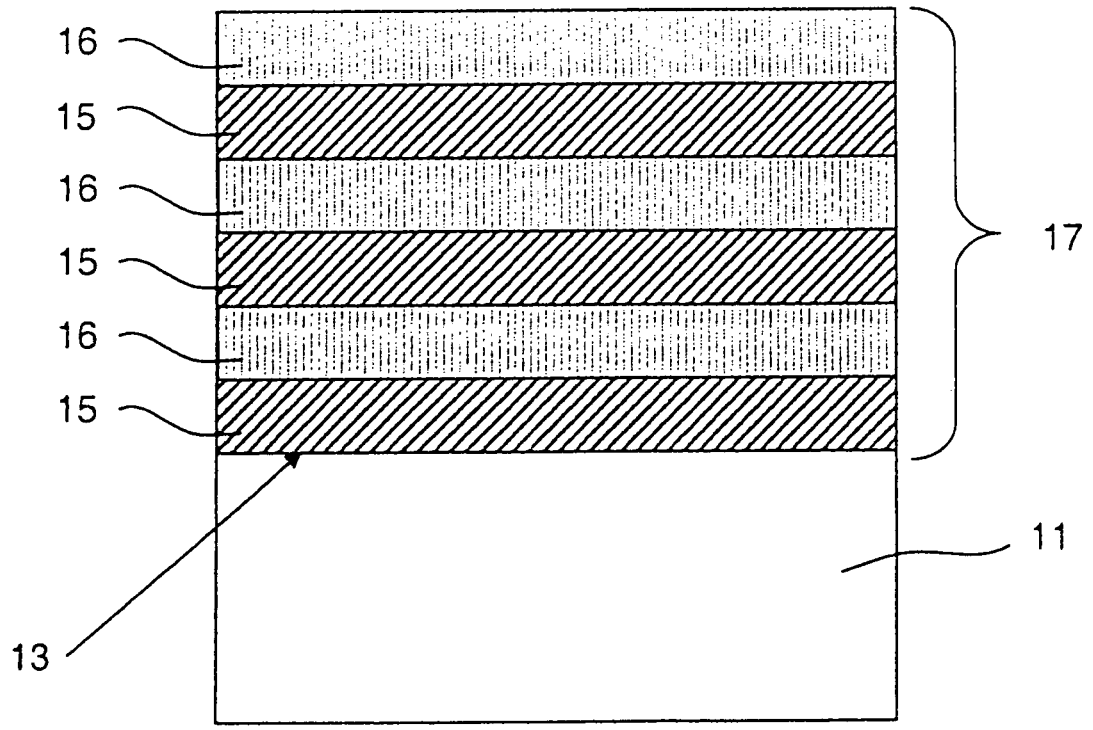
FIG. 3 shows a schematic cross-section through an alternative wear-protection coating.

For this purpose, in the sense of the inventive method, one proceeds in such a manner that an at least two-layered or at least two-plied wear-protection coating is applied onto the surface 13. Thus, for example FIG. 2 shows that a two-plied or two-layered wear-protection coating 14 of a relatively soft metallic layer 15 and a relatively hard ceramic layer 16 is applied onto the surface 13 of the vane blade 11. The relatively soft metallic layer 15 is applied directly onto the surface 13 and has a material composition that is adapted to the material composition of the vane blade 11. FIG. 3 shows a wear-protection coating 17 that is built-up of several relatively soft metallic layers 15 as well as several relatively hard ceramic layers 16. The concrete number of the relatively hard ceramic layers as well as the concrete number of the relatively soft metallic layers is of subordinate significance for the present invention and is up to the selection of the expert in the field addressed here.

In the sense of the present invention, the component coated with the wear-protection coating 14, 17 is subsequently subjected to a surface densifying through especially ball blasting or shot peening. The energy applied to the wear-protection coating 14 or 17 during the shot peening can be elastically diminished or dissipated in the relatively soft metallic layers 15 due to the above described multilayer construction of the wear-protection coating. There is then no danger of damages of the relatively hard ceramic layers 16.

With the inventive method it is possible, after the coating of a component with a wear-protection coating embodied as a multilayer coating system, to establish an optimal stress gradient or course or distribution over the wear-protection coating as well as the component through subsequent surface densifying, without the existence of the danger of damages of the wear-protection coating.

Figure 4:
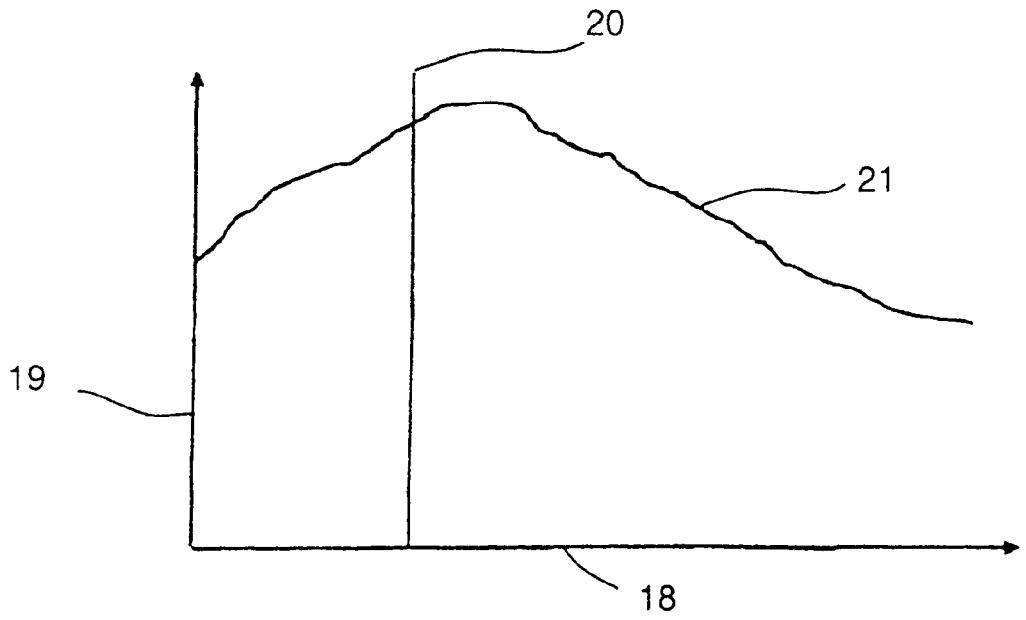
FIG. 4 shows a diagram for the clarification of the compressive stress gradient or course that arises in the coated component upon carrying out the inventive method.

Thus, FIG. 4 shows a diagram in which the depth of the coated component beginning from the surface thereof is indicated on the horizontally extending axis 18, and the compressive stress induced in the component with the aid of the inventive method is indicated on the vertically extending axis 19. The surface of the un-coated component is illustrated with the line 20; thus the area to the left of the line 20 relates to the wear-protection coating, the area to the right of the line 20 relates to the component as such. With the inventive method, the compressive stress gradient or course or distribution characterized with the reference number 21 can be realized over the depth of the coated component.

In the use of the inventive method for the production of a component coated with a wear-protection coating, the vibration strength of the base material of the coated component is fully maintained. With corresponding selection of the parameters for the shot peening or surface densifying, furthermore a smoothing effect can be achieved on the surface of the coated component.

As already mentioned, the inventive method is preferably applied for the coating of gas turbine vanes, which are formed of a titanium based alloy or nickel based alloy. Thus, for example vanes of a turbine or a compressor of an aircraft engine can be coated with the inventive method.

In closing, it is pointed out that the relatively soft metallic layers can also be embodied as porous layers. Furthermore it is possible to arrange a graded material layer between a relatively soft metallic layer and a relatively hard ceramic layer. The layers are preferably applied onto the surface of the component to be coated, by a PVD (Physical Vapor Deposition) process.

The invention claimed is:

1. A method of producing a coated component, comprising steps:

a) providing a component substrate having a substrate surface;

b) applying at least two layers including at least one metallic layer and at least one ceramic layer on at least a portion of said substrate surface, one above the other, to form a protective coating being a wear-protection coating, a corrosion-protection coating or an erosion-protection coating, wherein said at least one ceramic layer respectively has a hardness greater than a hardness of said at least one metallic layer respectively, and wherein an outer surface of said protective coating facing away from said substrate is formed by at least one said ceramic layer; and c) after said step b), performing ball blasting or shot peening on said outer surface of said protective coating on said substrate surface of said component substrate, whereby energy is applied to said protective coating by said ball blasting or shot peening, and dissipating said energy in said at least one metallic layer sufficiently so as not to cause damage of said outer surface formed by at least one said ceramic layer.

2. The method according to claim 1, wherein said metallic layer is a porous metallic layer.

3. The method according to claim 1, wherein said metallic layer is applied directly on said substrate surface and thereafter said ceramic layer is applied on said metallic layer.

4. The method according to claim 1, wherein a metal material composition of said metallic layer is matched to a metal material composition of said component substrate.

5. The method according to claim 1, wherein said at least two layers further include a graded material layer between said metallic layer and said ceramic layer.

6. The method according to claim 1, wherein said applying of said layers is carried out by physical vapor deposition.

7. The method according to claim 1, wherein said at least one metallic layer comprises a plurality of said metallic layers, said at least one ceramic layer comprises a plurality of said ceramic layers, and said metallic layers and said ceramic layers are applied alternately in succession one after another.

8. The method according to claim 1, wherein said ball blasting or shot peening is performed so as to maintain a vibration strength of a substrate material of said component substrate, and so as to achieve a surface smoothing of a surface of said protective coating on said component substrate.

9. The method according to claim 1, wherein said ball blasting or shot peening is performed to establish a stress gradient over said protective coating and in said component substrate under said protective coating, so that said stress gradient comprises a stress distribution that increases with depth from a surface of said protective coating through a thickness of said protective coating, up to a peak in said component substrate under said protective coating, and then diminishes from said peak with increasing depth into said component substrate.

10. The method according to claim 1, wherein said component is a gas turbine component.

11. The method according to claim 10, wherein said gas turbine component is a gas turbine vane, and said portion of said substrate surface comprises at least a portion of a vane blade surface thereof.

12. The method according to claim 1, wherein, in said step c), a surface of said coated component is smoothed.

* * * * *